United States Patent [19]

Leftault, Jr. et al.

[11] Patent Number: 4,836,398

[45] Date of Patent: Jun. 6, 1989

[54] INWARDLY REFORMABLE ENDWALL FOR A CONTAINER

[75] Inventors: Charles J. Leftault, Jr., Murrysville; W. Coy Willis, Verona, both of Pa.

[73] Assignee: Aluminum Company of America, Pittsburgh, Pa.

[21] Appl. No.: 150,228

[22] Filed: Jan. 29, 1988

[51] Int. Cl.[4] ..... B65D 1/16

[52] U.S. Cl. ..... 220/66

[58] Field of Search ..... 220/70, 67, 66

[56] References Cited

U.S. PATENT DOCUMENTS

| | | | |
|---|---|---|---|
| 868,078 | 10/1907 | Dunlap | 220/67 |
| 2,124,959 | 7/1938 | Vogel | 226/82 |
| 2,329,311 | 9/1943 | Waters | 226/51 |
| 3,103,089 | 9/1963 | Allen | 53/37 |
| 3,117,873 | 1/1964 | Bartels et al. | 99/171 |
| 3,160,302 | 12/1964 | Chaplin | 215/38 |
| 3,279,640 | 10/1966 | Dodson | 220/70 X |
| 3,342,009 | 9/1967 | Anderson | 53/22 |
| 3,400,853 | 9/1968 | Jacobsen | 220/66 |
| 3,409,167 | 11/1968 | Blanchard | 220/66 |
| 4,120,419 | 11/1978 | Saunders | 220/66 |
| 4,134,354 | 1/1979 | Cvacho et al. | 113/120 |
| 4,177,746 | 12/1979 | Lee, Jr. et al. | 113/120 |
| 4,179,914 | 12/1979 | Dulmaine et al. | 72/358 |
| 4,199,073 | 4/1980 | Gombas | 220/70 X |
| 4,222,494 | 9/1980 | Lee, Jr. et al. | 220/66 |
| 4,228,911 | 10/1980 | Hammes | 220/70 X |
| 4,338,765 | 7/1982 | Ohmori et al. | 53/452 |
| 4,381,061 | 4/1983 | Cerny et al. | 215/1 C |
| 4,402,419 | 9/1983 | MacPherson | 220/70 |
| 4,497,855 | 2/1985 | Agrawal et al. | 428/35 |
| 4,522,015 | 6/1985 | Hildebolt | 53/425 |
| 4,560,566 | 12/1985 | Roth | 426/399 |
| 4,616,761 | 10/1986 | Nolan | 215/271 |
| 4,642,968 | 2/1987 | McHenry et al. | 53/425 |
| 4,667,454 | 5/1987 | McHenry et al. | 53/425 |

FOREIGN PATENT DOCUMENTS

| | | | |
|---|---|---|---|
| 2133375 | 7/1984 | United Kingdom | 220/70 |

*Primary Examiner*—Donald F. Norton

*Attorney, Agent, or Firm*—David W. Brownlee; Thomas J. Connelly

[57] ABSTRACT

This invention relates to an endwall for a container having a panel portion surrounded by a substantially vertical wall portion which terminates into a narrow rim. The rim is connected to a sidwall of the container. The wall portion extends outward from the container and is adapted to be reformed inwardly into the container in a controlled manner by an external mechanism to reduce the volume thereof after the container has been filled and sealed. The invention also relates to a method of packaging a product in a container having a body opened at one end and closed at an opposite end by an endwall as described above. The method includes the steps of filling the container with a product and sealing the open end, thermally treating the filled and sealed container, and reforming the endwall inwardly into the container. The sequence of steps can be rearranged.

13 Claims, 5 Drawing Sheets

Fig. 4
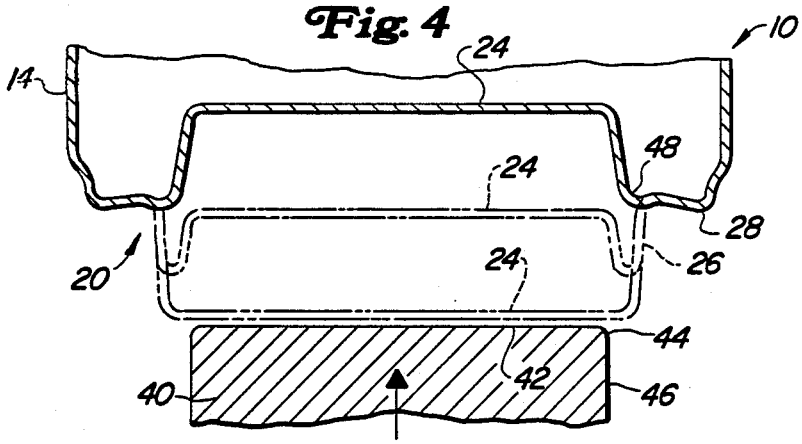
Fig. 5
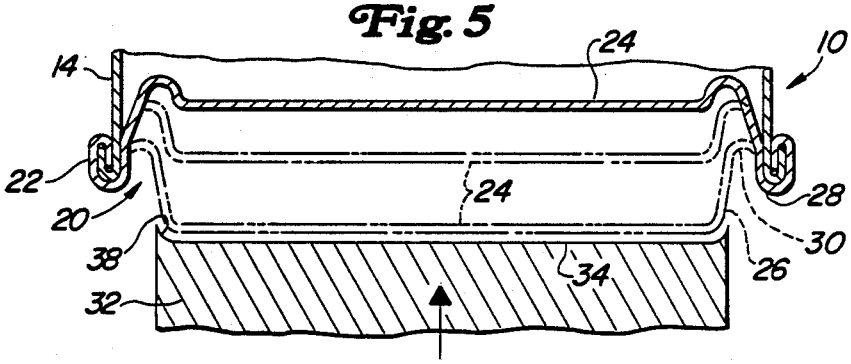
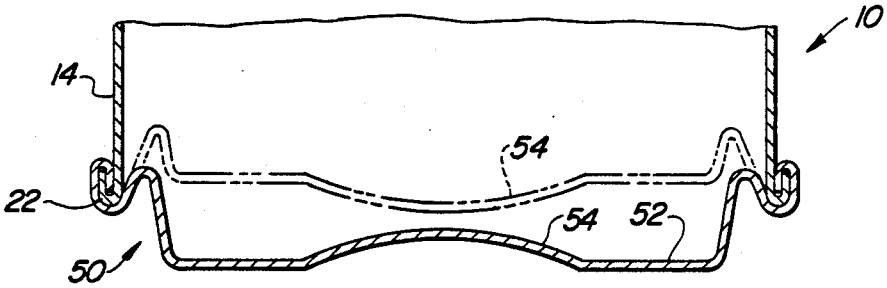
Fig. 6

INWARDLY REFORMABLE ENDWALL FOR A CONTAINER

FIELD OF THE INVENTION

This invention relates to an inwardly reformable endwall for a container and a method of packaging a product in the container and reforming the endwall after the container has been sealed to increase the pressure within the container in a controlled manner and to a predetermined value.

BACKGROUND OF THE INVENTION

Containers made of metal, glass or a thermoplastic material are commonly used to package various food products such as vegetables and fruit which are normally filled at elevated temperatures. Some food products may require an additional cooking or retorting cycle, after which the package is cooled to room temperature. Using atmospheric pressure as zero pressure, these packaging procedures produce internal pressures during the process cycle and partial vacuums during the cooling cycle. A partial vacuum in a glass container does not produce sidewall buckling or paneling because of the structural integrity of the glass itself. However, in thin-walled metal containers, especially aluminum containers, and even more so in plastic containers, sidewall paneling becomes noticeable for hot filled food products. This sidewall deformation results from the differential pressure present between the interior and exterior walls of the container. The differential pressure is increased whenever the packaged product chemically reacts with oxygen present in the headspace of a filled and sealed container. Such chemical reaction causes a decrease in the internal pressure of a container.

Those skilled in the art know that variations in a product's fill temperature, headspace, product volume, container expansion-contraction properties, processing conditions, and type of product to be packaged all influence the final differential pressure acting between the interior and exterior walls of a container. These packaging variations can lead to different degrees of sidewall buckling or paneling which must be overcome in order to present a commercially acceptable and aesthetically pleasing package. Sidewall paneling can also adversely affect a container during shipping and handling by creating excessive column load and/or prevent proper nesting and stacking with adjacent containers.

Present measures taken to prevent sidewall distortion in thin-walled metal and plastic containers vary depending upon the package design. Some containers utilize sidewall ribbing or beading to provide structural strength while others use bellows or buttons formed in an endwall which flex according to changes in the container's internal pressure or vacuum. Another measure taken to limit sidewall flexing incorporates the injection of liquid nitrogen which expands in the sealed container to preclude the development of a partial vacuum inside the container. Few containers use an increased sidewall thickness because it is not economically feasible.

A specific way of providing sidewall support and decreased internal vacuum is taught in U.S. Pat. No. 3,117,873. In this patent, a mechanical force is applied to an endwall causing a bead formed in the sidewall to collapse thereby shortening and stiffening the container. An alternative procedure, shown in FIGS. 10–14 of the '873 patent, reverses a domed endwall by use of a plunger to accomplish limited volume displacement in an uncontrolled manner. The following U.S. Pat. Nos.: 4,381,061; 4,222,494; 4,177,746; 4,134,354; 3,409,167; 3,400,853 and 3,160,302, teach the use of a flexible endwall on a container which can flex from a convex to a concave configuration in a cricketing or reversing fashion so as to minimize sidewall distortion. Lastly, specific ribbed and paneled sidewall designs are shown in U.S. Pat. Nos. 3,497,855 and 4,120,419.

Despite the above-suggested solutions to the sidewall paneling problem, there is a very real need for an improved and cost-efficient container. This need is most noticeable for containers designed to be filled with a hot product and sealed before being cooled to room temperature and for containers designed to be filled with a product at room temperature before being pressurized. Now a container has been invented which can satisfy this need.

SUMMARY OF THE INVENTION

Briefly, the present invention relates to an inwardly deformable endwall which can be either integrally formed with or connected to the body of a container. The endwall has a panel portion surrounded by a wall portion which terminates into a relatively narrow rim. The rim is connected to the sidewall of the container. The wall portion extends outward from the container and is adapted to be reformed inwardly in a controlled manner by an external mechanism after the container has been filled and sealed. As the panel portion is pressed inwardly into the container, the wall portion is reformed in a controlled manner such that the volume of the container is reduced and the internal pressure is increased. When a hot filled food product is sealed in a container, a partial vacuum occurs upon cooling and the above-described inward reforming of the endwall can restore the container to any preselected internal pressure.

This invention also relates to a method of packaging a product in a container. The method includes the steps of filling a container with a solid or liquid product, preferably at an elevated temperature when the product is a food substance. A lid is applied over the open end of the container and is sealed in place, such as by the formation of a double seam. The package can then be heated to a still higher temperature, if desired, before it is cooled down to room temperature. The cooling step will create a partial vacuum in a hot filled product. Before, during or after the cooling step, the endwall of the container is reformed inwardly into the container in a controlled manner by an external force. The inward reforming of the endwall will increase the internal pressure and reduce the volume of the container.

The general object of this invention is to provide an endwall for a container which is designed to be reformed inwardly into a filled and sealed container thereby increasing the internal pressure and preventing sidewall paneling from occurring. A more specific object of this invention is to provide an inwardly reformable endwall for a container filled and sealed with a hot food product such that volume reduction within the container can be controlled in a precise manner and to a preselected value.

Another object of this invention is to provide a method of packaging a product in a thin-walled metal or plastic container while preventing the sidewalls of the container from buckling or paneling.

Still another object of this invention is to provide a relatively simple and inexpensive container and a method of packaging a hot filled food product in the container such that a preselected positive pressure can be created within the container after it has been filled and sealed.

Still further, an object of this invention is to provide an endwall which can be reformed inwardly into a large or small volume container to produce a desired volume displacement regardless of the temperature at which the product was packed.

A still further object of this invention is to provide a container with an endwall which can be reformed inwardly into the container to provide a desired internal pressure ranging from a partial vacuum to values above atmospheric pressure.

Other objects and advantages of the present invention will become more apparent to those skilled in the art in view of the following description and the accompanying drawings.

BRIEF DESCRIPTION OF THE DRAWINGS

FIG. 4 is a cross-sectional view of a lower portion of the container of FIG. 1 showing sequential inward reforming of the bottom endwall by a panel drive mechanism.

FIG. 5 is a cross-sectional view of a lower portion of a container having a bottom endwall seamed onto a peripheral sidewall and showing sequential inward reforming of the bottom endwall by a radius drive mechanism.

FIG. 6 is a cross-sectional view of a lower portion of a container having a bottom endwall seamed onto a peripheral sidewall and having a central concave button which becomes inverted at a predetermined internal pressure caused by inward reforming of the bottom endwall.

DETAILED DESCRIPTION OF THE PREFERRED EMBODIMENTS

Figure 1:
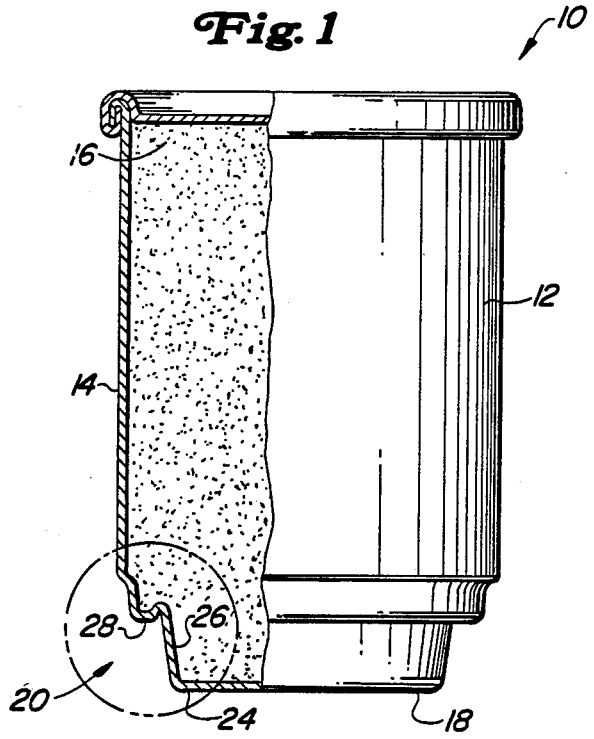
FIG. 1 is a partial cross-sectional view of a container filled and sealed with a product and having a bottom endwall which is designed to be reformed inwardly into the container.

Referring to FIG. 1, a container 10 is shown having a hollow body 12 constructed of a thin, flexible sidewall 14. The container 10, which can be in the form of a can, bottle or box, can be constructed of a metal material such as steel or aluminum, or an alloy thereof, or a thermoplastic or composite material. The container 10 can hold a carbonated or non-carbonated liquid or a moist or dry solid substance.

When the container 10 is in the form of a can, the hollow body 12 will preferably be cylindrical and will initially have an open end 16 and an opposite end 18. The opposite end 18 is initially closed by an endwall 20 which can be either integrally formed with the sidewall 14, as is shown in FIG. 1, or it can be mechanically joined thereto, for example, by a double seam 22, as is shown in FIG. 5. The endwall 20 is preferably constructed of a similar or identical material as the sidewall 14, although a different material can be used if desired. For metal containers, both the endwall 20 and the sidewall 14 can be formed in a typical stamping operation.

Figure 2:
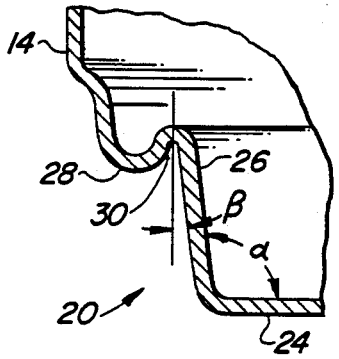
FIG. 2 is a partial exploded view of the circled section shown in FIG. 1 detailing the structural features of the endwall.

Referring to FIG. 2, the endwall 20 includes a panel portion 24 surrounded by a wall portion 26. The wall portion 26 can have a substantially vertical or frustoconical configuration and forms an inside angle $\alpha$ between itself and the panel portion 24 which is at least equal to or greater than 90°. Preferably, the angle $\alpha$ is between 90° and 120°, and most preferably, $\alpha$ will be between 90° and 95° when the wall portion 26 is substantially perpendicularly aligned with the panel portion 24. When the wall portion 26 is frustoconical in configuration, a second angle $\beta$ is formed relative to a vertical line drawn through an end surface of the wall portion 26 and parallel to the longitudinal axis of the container 10. With the container 10 being positioned in an upright position with the open end 16 at the top, the angle $\beta$ should be between 0° and 30°, preferably about 10°. The formation of the wall portion 26 according to the parameters listed above will minimize wrinkling thereof as the endwall 20 is plastically, rather than elastically, reformed into the container 10.

The wall portion 26 terminates into a narrow rim 28 which, in turn, is connected to the sidewall 14. Formed between the wall portion 26 and the rim 28 is an outwardly open, curvilinear channel 30 which assists in controlling the direction of movement of the wall portion 26 as the endwall 20 is plastically reformed inwardly. For a thin-walled metal container 10 having the endwall 20 integrally formed with the sidewall 14, it is preferable that the rim 28 be at least 1/16 of an inch in width. If the rim 28 is too narrow, then the sidewall 14 of the container 10 will buckle during reforming of the endwall 20. On the other hand, if the rim 28 is too wide, wrinkles will occur in its surface as the endwall 20 is reformed inwardly into the container 10. When the endwall 20 is reformed, it takes on an inverted hat-shaped configuration. In this configuration, the relatively flat panel portion 24 forms the crown of the hat and the narrow rim 28 forms the brim of the hat. The outwardly extending endwall 20 of the hat-shaped configuration is designed to be reformed inwardly into the body of a filled and sealed container, see FIGS. 3–5, while substantially retaining its hat-shaped profile. This hat-shaped profile also permits nesting or stacking of filled and sealed containers in a vertical arrangement so they can be placed on a pallet for shipping. It should be noted that although the endwall 20 is shown as extending outward from the end of the sidewall 14 of the container 10, it is possible to form the endwall 20 such that it is initially flush with an end of the sidewall 14 and can be deformed inwardly thereof.

Figure 3:
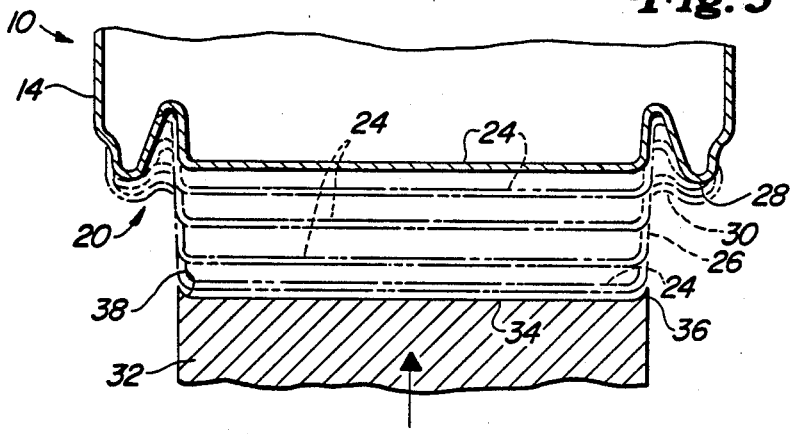
FIG. 3 is a cross-sectional view of a lower portion of the container of FIG. 1 showing sequential inward reforming of the bottom endwall by a radius drive mechanism.

Referring to FIGS. 3–5, the endwall 20 is shown being reformed inwardly into the sidewall 14 of the container 10. In FIG. 3, an external radius drive mechanism 32 is depicted which contains a flat contact surface 34 surrounded by an outwardly extending peripheral sleeve 36. The sleeve 36 can contain an inner radius 38 which matches a radius formed on the endwall 20. Preferably, the contact surface 34 and the sleeve 36 are sized and shaped to mate with the diameter of the panel portion 24. The radius drive mechanism 32 can be mechanically, hydraulically, pneumatically or electrically actuated so as to be brought into contact with the panel portion 24 and reform the endwall 20 inwardly into the container 10 while simultaneously displacing the panel portion 24 inwardly. The radius drive mechanism 32 is designed to reform the endwall 20 after the container 10 has been filled with a product and sealed. The product can be elevated in temperature so as to sterilize, pasteurize, or cook it, and then is cooled down towards room temperature. During the cooling process, a vacuum normally occurs within the container especially when the product is a food product. This vacuum has a tendency to cause the flexible sidewalls 14 to panel or buckle inwardly once the container 10 and product are cooled to room temperature. By reforming the endwall 20 inwardly into the container 10, one can reduce the volume of the container 10 and also create a positive pressure within the container 10. This is advantageous in limiting or reducing sidewall paneling and also presents an aesthetically pleasing container. In this regard, the actuator which is designed to move the radius drive mechanism 32 can be designed relative to the diameter, shape, height or volume of the container such that incremental inward displacement of the panel portion 24 will provide an incremental increase in pressure. By calculating volume displacement or pressure increase versus inward displacement of the panel portion 24, one can accurately calculate the extent to which the endwall 20 must be reformed in order to obtain a preselected pressure or volume figure. This is a novel feature for it permits an operator to increase the pressure and reduce the volume of a filled and sealed container in a controlled manner.

In FIG. 3, one can observe that the radius 38 on the drive mechanism 32 will contact the radius formed between the panel portion 24 and the wall portion 26, and movement of the drive mechanism 32 inwards into the container 10 will cause the wall portion 26 to reform. The length of the wall portion 26 and its angle $\alpha$ relative to the panel portion 24, as well as its connection to the rim 28, will dictate at which point the wall portion 26 will be reformed. Preferably, the wall portion 26 will be rolled or curled inwardly relative to its connection point with the rim 28. As the endwall 20 is reformed, the curvilinear channel 30 will acquire a deeper trough while the wall portion 26 shortens in length. For a cylindrical container, the channel 30 can be visualized as an annular groove which decreases in diameter as the panel portion 24 retains its diameter and is displaced inwardly. This decrease in the diameter of the groove is relatively small and will vary depending upon the diameter of the container 10 and the configuration of the endwall 20. However, it should be noted that the length of the wall portion 26 and the width of the rim 28 are critical in minimizing distortion or wrinkling of the endwall 20 during the reforming process. The curvilinear channel 30 should control the direction of movement of the wall portion 26 during the reforming process such that the wall portion 26 is rolled or curled adjacent its ends. As can be clearly seen in FIG. 3, the overall height of the wall portion 26 will be substantially reduced during reforming which. in turn, will shorten the overall height of the container 10. For a typical aluminum food container having a diameter of about 3 to 5 inches and a height of about 4 to 7 inches, it is possible to increase the internal pressure within the filled and sealed container from between 1 and 50 psig while reducing the volume from 1 to 10% with a displacement of the endwall 20 of between 0 and 1 inch. Since the container 10 can have its endwall 20 reformed quickly by a simple mechanical apparatus, it lends itself well to presently available food or liquid processing lines.

Referring to FIG. 4, a panel drive mechanism 40 is shown as an alternative to the radius drive mechanism 32. The panel drive mechanism 40 contains a relatively flat contact surface 42 which is preferably circular in configuration and has a radius 44 formed at the corner of the adjacent sidewall 46. The contact surface 42 has a diameter slightly less than the diameter of the panel portion 24 formed in the endwall 20. The panel drive mechanism 40 can be mechanically, hydraulically, pneumatically or electrically actuated so as to reform the wall portion 26 while simultaneously displacing the panel portion 24 inwardly into the container 10.

In operation, the panel drive mechanism 40 contacts the panel portion 24 and displaces it inwardly, thereby causing the wall portion 26 to be rolled or curled inwardly at its end adjacent the panel portion 24. This inward rolling or curling forms a channel 48 having an upwardly facing annular groove which controls the direction of movement of the wall portion 26 during reforming. The panel portion 24 decreases in diameter upon being displaced inwardly into the container 10 as the wall portion 26 is being reformed in a controlled manner. The panel portion 24 can be displaced inwards a predetermined amount so as to obtain a desired internal pressure within the container 10 and also reduce the volume therein. Depending upon the size, shape and diameter of the container 10, one can calculate the amount of displacement necessary to obtain a desired volume reduction and pressure increase. One will notice in FIG. 4 that by using the panel drive mechanism 40, the endwall 20 acquires a hat-shaped profile which is similar to that obtained using the radius drive mechanism 32, except that it is inverted. Using either drive mechanism, the reforming process will accomplish the same function within the filled and sealed container.

Referring to FIG. 5, an alternative hat-shaped profile is obtained when a container 10 is utilized having the endwall 20 mechanically joined by a double seam onto the sidewall 14. Using a radius drive mechanism 32, the endwall 20 is reformed while the panel portion 24 decreases in diameter upon being displaced inwardly into the container 10. When the endwall 20 is mechanically joined or seamed onto the endwall 14, the rim 28 will normally contain a very narrow width and be inclined so as to form one wall of the channel 30. This structure will cause the endwall 20 to be reformed in a slightly different way. It should be noted, however, that the size, shape and diameter of the container 10 will dictate the initial width of the rim 28.

Referring to FIG. 6, an alternatively designed endwall 50 is shown mechanically joined such as by a double seam 22 onto the sidewall 14 of a container 10. The endwall 50 contains a panel portion 52 having a central area or button 54 which has an initial concave configuration relative to the exterior of the container 10. The remainder of the endwall 50 is identical to that shown in FIG. 5. The button 54 is designed to deflect outward and acquire a convex configuration as the endwall 50 is reformed. As the endwall 50 is reformed inwardly, the internal pressure within the filled and sealed container 10 will increase to a preselected value at which point the button 54 will deflect outwards. This outward deflection of the button 54 can be advantageously utilized to provide visual evidence to a machine operator that the container 10 has been pressurized to a desired value. The drive mechanism which is used to reform the endwall 50 can be designed to contain a pressure sensing plunger or pin such that once the button 54 deflects outwardly, the sensor would sense this deflection and send a signal to a control mechanism to stop the movement of the drive mechanism. Within the scope of this invention, it is visualized that a sensor could also be brought into contact with the sidewall 14 of the container 10 such that as the endwall 50 was reformed inwardly, the internal pressure within the container 10 would exert a force on the sidewall 14 causing it to move outward. The outward movement of the sidewall from a concave to a vertical configuration or from a vertical to a convex configuration would trip the sensor which, in turn, would relay a signal to the drive mechanism to stop depressing the endwall 50 into the container 10.

METHOD OF PACKAGING A PRODUCT IN A CONTAINER

The operational alternative steps utilized to package a product in a container using the above-identified endwall and reforming apparatus will now be described in reference to FIGS. 7–11.

Figure 7:
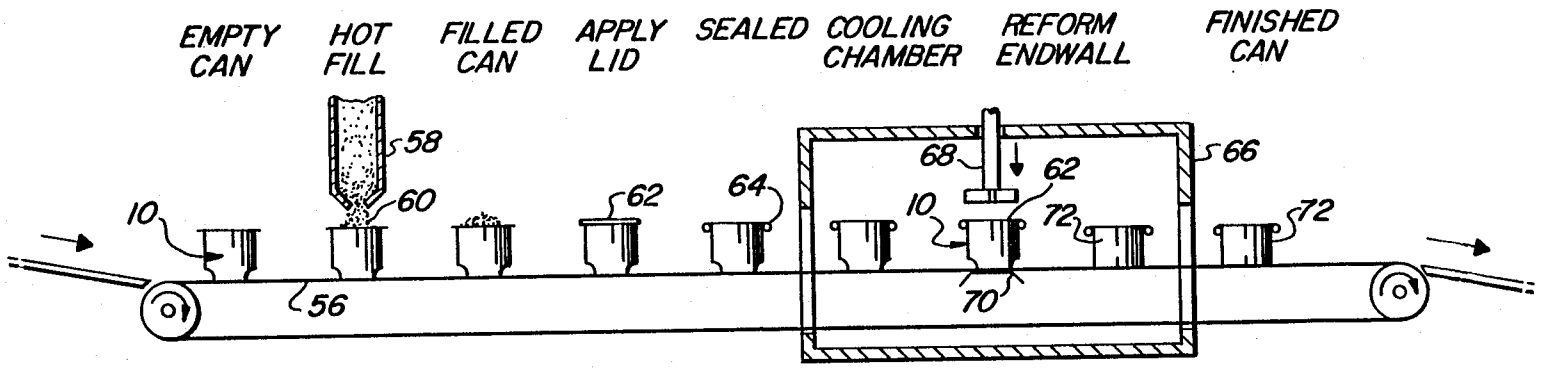
FIG. 7 is a diagrammatic view showing sequentially the steps involved in a method of packaging a product in accordance with the invention.

In FIG. 7, a plurality of containers 10 having a cylindrical sidewall 14 closed at a bottom end by an endwall 20 are sequentially fed onto a conveyor 56. Each empty container 10 is aligned beneath a fill hopper 58 and receives a meter charge of a product 60. The product 60 can be a hot or cold, liquid or solid substance, but for purposes of discussion, it is depicted as a solid granular food substance which has been heated in temperature. The filling operation can be equated to a hot filled operation as is commonly known to those skilled in the art. The filled container can then be subjected to an optional vibration or leveling step wherein the product 60 is packed or compacted within the container 10. A cover or lid 62 is applied over the open end 16 of the container 10 and is sealed onto the container 10 as is denoted by numeral 64. In FIG. 7, the cover 64 has a slightly larger diameter than the upper flange of the container 10 so that it can be double seamed onto the container to form the seal 64. The sealed container is then conveyed into a cooling chamber where the temperature of the hot filled product is reduced to room temperature. Normally a hot food product is filled at a temperature of approximately 180° to 200° F. and is sealed in the container before it is cooled. During the cooling process, a vacuum will form within the sealed container causing the flexible sidewalls 14 to buckle or deform inwardly. Such buckling presents an aesthetically unpleasing container and gives the consumer the impression that the container has not been completely filled. By reforming the endwall 20 into the container 10, the sidewall buckling can be essentially eliminated. In this regard, the container 10 is reformed by a drive mechanism 68 which cooperates with a backup plate 70. For the purpose of illustration, the drive mechanism 68 is shown contacting the top surface or cover 62 of the container 10, although it is preferable to reverse the position of the drive mechanism 68 and the backup plate 70 so as to push upwards on the bottom endwall 20, as is shown in FIGS. 3–5. It should be noted that the container 10 can be supported in some other desirable fashion during the reforming operation, for example, in a tubular fixture which surrounds at least a portion of the sidewall 14 so as to hold the container stationary. When the container 10 has an initial outwardly extending endwall 20, the endwall 20 can be reformed inwardly such that the relatively flat panel portion 24 can be displaced inwardly with respect to the interior of the container 10. It is possible to reposition the panel portion 24 so that it is flush with or inboard of the end of the container 10. In FIG. 7, the finished container 72 is shown having a shorter profile than the empty container 10. The shortened containers 72 are sequentially removed from the conveyor 56 and are then made ready for shipment.

Figure 8:
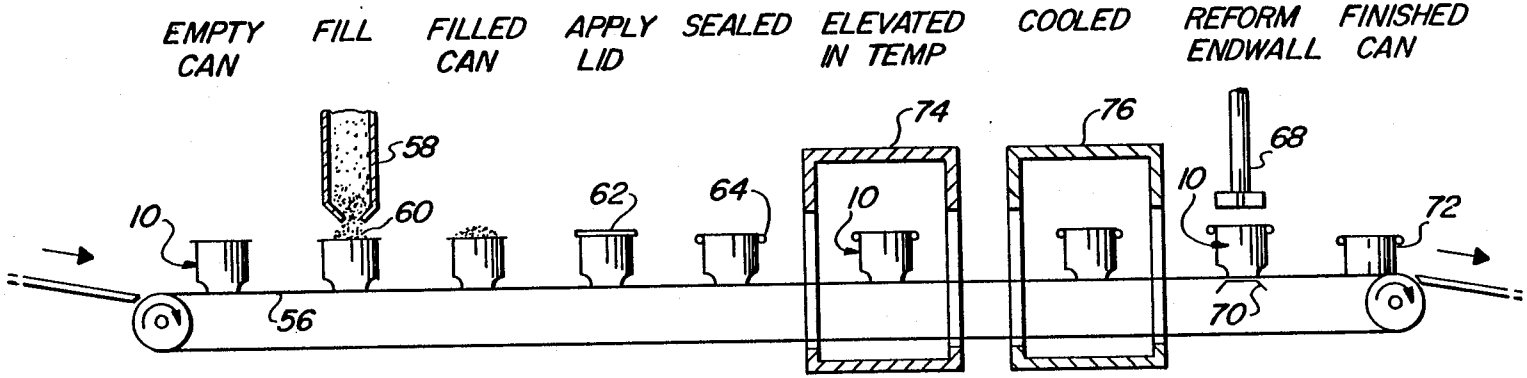
FIG. 8 is a diagrammatic view showing sequentially the steps involved in an alternative method of packaging a product in accordance with the invention.

Referring to FIG. 8, an alternative method of packaging a product in the container 10 is shown. In this process, either a hot or cold filled product 60 is dispensed into the incoming empty containers 10. Each container 10 is then closed with a cover 62 and sealed as by the formation of a double seam 64. The filled and sealed container 10 is routed to heating chamber 74 where the product 60 is elevated to a predetermined temperature. If the product 60 was filled at room temperature, approximately 60°–80° F., then it can be elevated to a temperature of, say, between 100°–200° F. If the product 60 was packed at a hot filled temperature of between about 175°–225° F., then it may be elevated to a temperature approaching 250° F. within the heating chamber 74. The particular temperature and time period for which the product 60 will be thermally processed will depend on the type of product and the desired temperature necessary for sterilization, pasteurization, cooking, etc. Upon leaving the heating chamber 74, the filled and sealed container 10 enters a cooling chamber 76 wherein it is cooled down towards or to room temperature. During the cooling process, the internal pressure will decrease and a vacuum could form within the container 10. The cooled container 10 is then reformed as by a drive mechanism and a backup plate 68 and 70, respectively, to form a shorter finished container 72. As stated earlier, the reforming operation can be performed either at room temperature or at any temperature above room temperature. However, utilizing present packaging equipment, it would probably be most advantageous to reform after cooling the product to room temperature.

Figure 9:
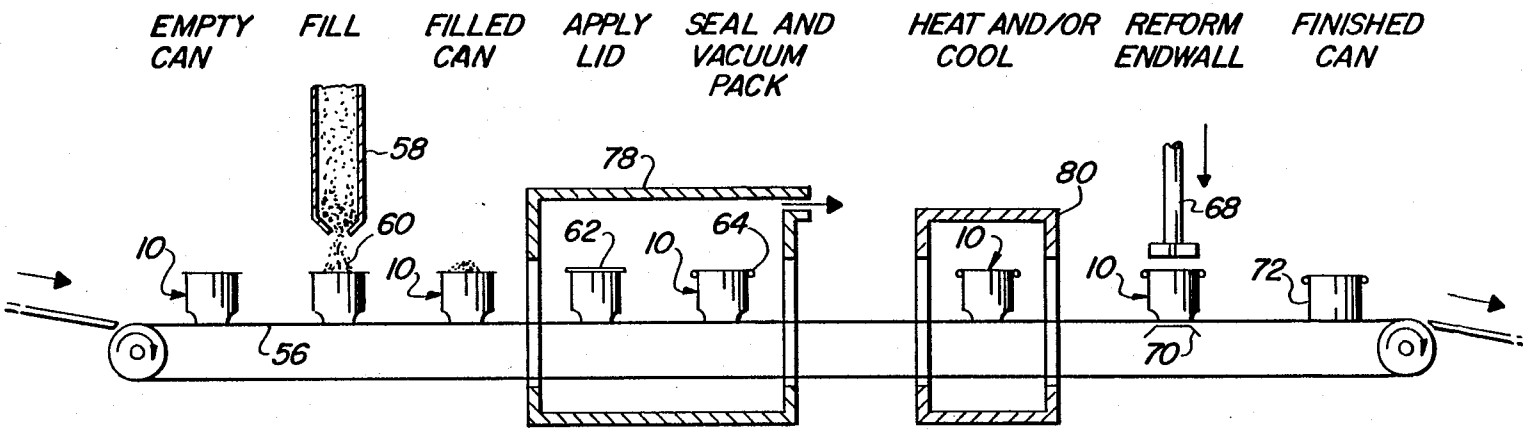
FIG. 9 is a diagrammatic view showing sequentially the steps involved in a third method of packaging a product in accordance with the invention.

Referring to FIG. 9, a third method of packaging a container is shown. As in the previous processes, empty cans 10 are sequentially fed onto and conveyed along a conveyor 56 and each is aligned under a fill apparatus 58 wherein a hot or cold liquid or solid product is dispensed therein. The filled can 10 is then routed to a vacuum chamber 78 wherein a cover or lid 62 is placed over the open end of the container 10 and is sealed thereto such as by the formation of a seam, a weld or by some other means. The covering and sealing are performed within the vacuum chamber 78 so as to remove any undesirable gas or oxygen from the food product 60 so as to increase its potential life. The sealed container 10 is then conveyed to a thermal chamber 80 wherein the filled and sealed container 10 can be either elevated in temperature and then cooled or cooled to room temperature if hot filled. The heating or cooling which takes place within the thermal chamber 80 will be dependent upon whether the product 60 was hot or cold filled at the filling apparatus 58. Upon being partially or totally cooled to room temperature, the container 10 is subjected to a reforming operation which produces a shortened finished container 72.

Figure 10:
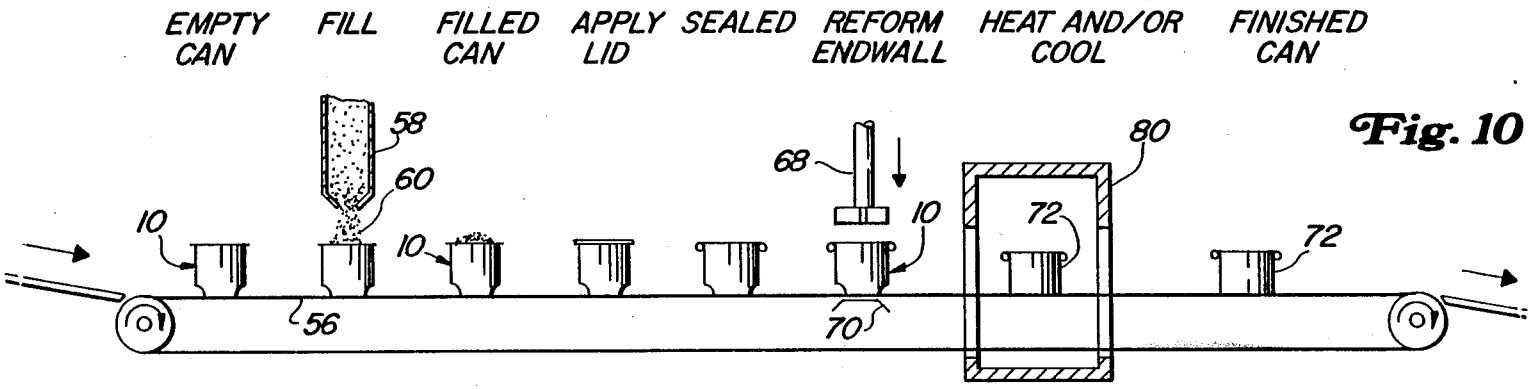
FIG. 10 is a diagrammatic view showing sequentially the steps involved in a fourth method of packaging a product in accordance with the invention.

Referring to FIG. 10, a fourth method of packaging a container is shown. As in the previous processes, empty cans 10 are sequentially fed onto and conveyed along a conveyor 56 and each is aligned under a fill apparatus 58 wherein a hot or cold, liquid or solid product is dispensed therein. A cover or lid 62 is applied over the open end of the container 10 and is sealed thereto such as by the formation of a seam, a weld, or by some other means. The sealed container is then subjected to a reforming operation, as explained earlier, which produces a shortened container 72. The container 72 is then routed to a thermal chamber 80 wherein it is heated or cooled to a desired temperature. The finished container 72 is then removed from the conveyor 56 and readied for shipment. This last method encompasses a reforming operation before the heating or cooling process and assures that the temperature within the container is increased prior to thermal treatment. It should be noted that portions of the above-described packaging processes can be interchanged or eliminated to accommodate packaging of a particular product. For example, a granular food product such as peanuts may require hot filling and vacuum sealing, as shown in the first half of FIG. 9. However, upon partial cooling, the container 10 may be reformed while still within the cooling chamber 76, as is shown in the second half of FIG. 7.

Figure 11:
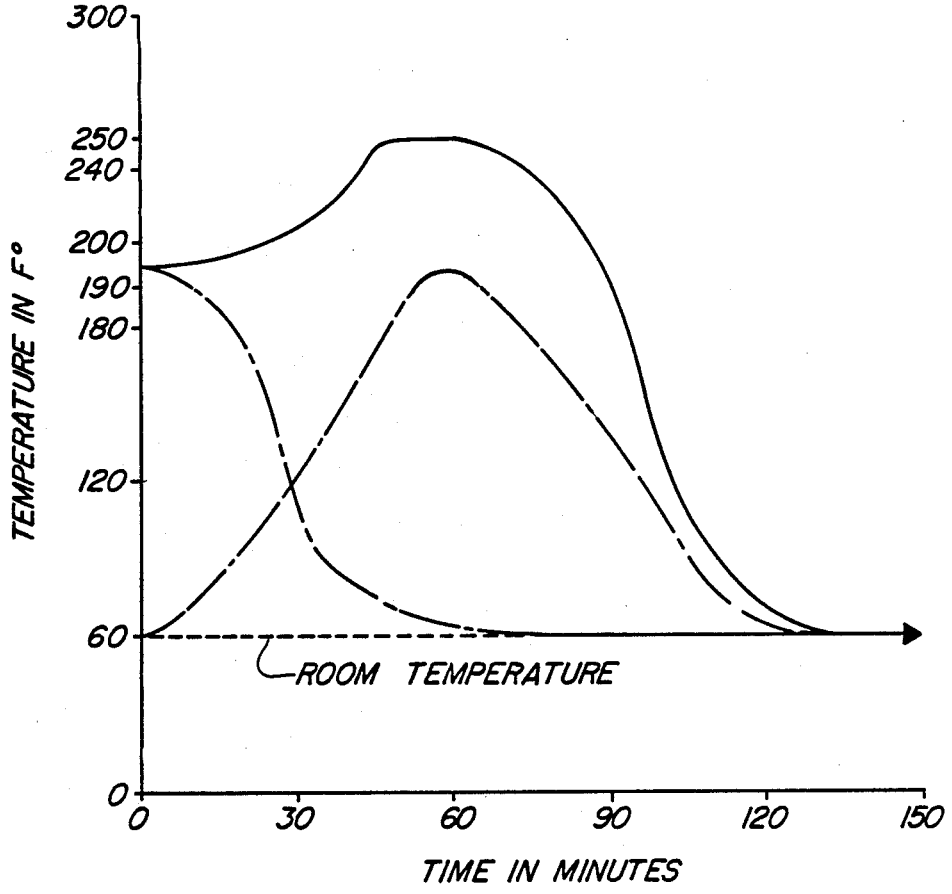
FIG. 11 is a chart depicting hot and cold packaging of a product into a container and alternative methods for conditioning the product after sealing the container.

Lastly, referring to FIG. 11, a chart is shown depicting the various processes that a hot or cold filled product can be subjected to. For a product filled at room temperature of approximately 60° F., the cold filled product can be covered and sealed and the container reformed all at room temperature. This is depicted by the horizontal dotted line. If the product requires a heating cycle, the filled and sealed container can be elevated in temperature and then cooled before reforming takes place, as is depicted by a bell-shaped dotted line. For a product which is hot filled at approximately 175°–225° F., it may be sufficient to merely cool the product to room temperature before the container is reformed since no further heating is required. This is depicted by the downwardly sloping dotted line. Lastly, a hot filled product may require being held at an elevated temperature so as to cook or pasteurize the product before it is cooled. This is depicted by the solid curved line.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A thin metal endwall for a container comprising a central panel portion surrounded by a substantially vertical wall portion projecting from said panel portion toward the inside of the container, said wall portion connected at its inner end to a relatively narrow rim radially outwardly surrounding said wall portion, with said rim being adapted to be connected to the sidewall of a container which has a greater perimetric extent than does said substantially vertical wall portion, so that said central panel portion can be displaced toward said container by mechanical force exceeding the elastic limit of the metal in said container wall to reduce the length of said vertical wall portion in a controlled manner and thereby reduce the volume in a container on which said end wall is secured.

2. An endwall as set forth in claim 1 in which said substantially vertical wall portion is frustoconical with its larger end connected to said relatively narrow rim.

3. An endwall as set forth in claim 2 in which said substantially vertical wall is disposed at an angle of 30° or less to the longitudinal axis of the frustoconical wall.

4. The endwall of claim 1, which is integral with a container body.

5. The endwall of claim 4 wherein said panel portion has inwardly concave central area which is adapted to deflect outwardly to a convex configuration when a preselected pressure value is reached during inward reforming of said endwall of a filled and sealed container.

6. The endwall of claim 1 wherein said wall portion is adapted to be plastically reformed by rolling inwardly at an end adjacent to said panel portion.

7. The endwall of claim 1 wherein said rim includes an outwardly open annular groove.

8. An endwall as set forth in claim 1 which is an aluminum alloy.

9. A metal endwall for a thin-walled cylindrical container comprising a frustoconical wall portion, a central panel portion closing the smaller end of said frustoconical wall portion and a relatively narrow rim outwardly around the larger end of said frustoconical wall portion, said rim being adapted to be connected to the sidewall of a container which has a larger diameter than the inner end of said frustoconical wall portion, so that said central panel portion can be displaced toward said container by mechanical force exceeding the elastic limit of the metal in said container wall to reduce the length of said frustoconical wall portion in a controlled manner and thereby reduce the volume in a container on which said end wall is secured.

10. A metal endwall as set forth in claim 9 which is integral with an aluminum can body.

11. A metal endwall as set forth in claim 10 in which said frustoconical wall is disposed at an angle of 30° or less to its longitudinal axis.

12. A thin-walled metal container comprising a cylindrical body and an integral endwall closing one end of the cylindrical body, said endwall including a frustoconical wall portion with its smaller end projecting from the end of the container and closed by a central panel portion and the larger end of said frustoconical wall portion connected to a relatively narrow rim outwardly surrounding said wall portion with said rim connected at its outer peripheral edge to the body of the container so that said central panel portion can be displaced toward said container by mechanical force exceeding the elastic limit of the metal in said container wall to reduce the length of said frustoconical wall portion in a controlled manner and thereby reduce the volume in a container on which said end wall is secured.

13. A metal container as set forth in claim 12 in which said frustoconical wall is disposed at an angle of 5° or less to the longitudinal axis of the container.

* * * * *